US005947769A

United States Patent [19]

Leonard et al.

[11] Patent Number: 5,947,769

[45] Date of Patent: Sep. 7, 1999

[54] SHIELDED ELECTRICAL CONNECTOR

[75] Inventors: Russell J. Leonard, Naperville, Ill.; Jay H. Neer, Boco Raton, Fla.

[73] Assignee: Molex Incorporated, Lisle, Ill.

[21] Appl. No.: 08/868,423

[22] Filed: Jun. 3, 1997

[51] Int. Cl.[6] ..... H01R 13/648

[52] U.S. Cl. ..... 439/607; 439/108

[58] Field of Search ..... 439/607–610, 439/79–83, 108

[56] References Cited

U.S. PATENT DOCUMENTS

| | | | |
|---|---|---|---|
| Re. 32,502 | 9/1987 | Kumar | 439/92 |
| 4,789,346 | 12/1988 | Frantz | 439/80 |
| 4,878,858 | 11/1989 | Dechelette | 439/607 |
| 4,913,664 | 4/1990 | Dixon et al. | 439/607 |
| 4,938,704 | 7/1990 | Fujiura | 439/607 |
| 4,943,244 | 7/1990 | Teck et al. | 439/567 |
| 5,066,237 | 11/1991 | Shiley | 439/82 |
| 5,085,589 | 2/1992 | Kan | 439/607 |
| 5,104,326 | 4/1992 | Smith et al. | 439/95 |
| 5,228,873 | 7/1993 | Hirai | 439/607 |
| 5,281,169 | 1/1994 | Kiat et al. | 439/607 |
| 5,344,327 | 9/1994 | Brunker et al. | 439/108 |
| 5,540,598 | 7/1996 | Davis | 439/79 |
| 5,564,945 | 10/1996 | Domingos et al. | 439/567 |
| 5,591,050 | 1/1997 | Sueoka | 439/607 |

FOREIGN PATENT DOCUMENTS

0469845A1 5/1992 European Pat. Off. .

*Primary Examiner*—Hien Vu
*Attorney, Agent, or Firm*—Stacey E. Caldwell

[57] ABSTRACT

A shielded electrical connector is adapted for mounting to a circuit board. The connector includes a dielectric housing having a bottom mounting portion adapted for mounting to the surface of the circuit board. A one-piece conductive shield is mounted on the housing and includes an integral ground strap for connection to an appropriate ground pad on the circuit board, an integral locating peg projecting below the bottom mounting portion and adapted for positioning in an appropriate locating hole in the circuit board, and an integral boardlock post projecting below the bottom mounting portion and adapted for positioning in an appropriate locking hole in the board. The shield has at least one ear portion wrapped about an edge of the housing, with the ear portion having a threaded aperture and a positioning tab snappingly interengaged with a locking shoulder on the housing.

16 Claims, 3 Drawing Sheets

SHIELDED ELECTRICAL CONNECTOR

FIELD OF THE INVENTION

This invention generally relates to the art of electrical connectors and, particularly, to a shielded electrical connector for mounting on a printed circuit board.

BACKGROUND OF THE INVENTION

In the electronics industry, electrical connectors are mounted to printed circuit boards, such as by right angled mounting, for electrical connection to circuit traces on the boards. A conventional shielded input/output (I/O) electrical connector includes a dielectric (plastic) housing having a plurality of terminal-receiving cavities or passages, with a plurality of terminals received in the passages. A metal shield surrounds a substantial portion of the housing to protect at least the mating portions of the terminals from RF and EMI interference as well as protecting the surroundings from interference radiating from the connector itself. The connector is mounted to the printed circuit board, and the terminals have tail portions for connection, as by soldering, to circuit traces on the board.

In some applications, such shielded connectors have some form of locking or retention feature, commonly called "boardlocks" to hold the connectors to the board. In other applications, the connectors include a commoning feature, such as mounting feet or ground straps, to ground the shield of the connector to a ground trace or pad on the board. In still other applications, the connectors might include locating means, such as locating pegs, for locating the connector at a predetermined position on the board. Heretofore, one or more of these features have been provided by separate components, independent of either the housing or the shield of the connector, to perform the respective functions. These separate components cause problems in significantly increasing the fabrication and assembly costs of the connectors.

Still further, such connectors often have apertures in planar flanges for receiving jack screws or jack screw posts. These jack screw receiving apertures consist of tapped (threaded) holes in the planar flange that, typically, are positioned at the lateral side of the connector. A problem with such structures is that the planar flange has a tendency to become bent or misaligned if it is not properly positioned or secured to the housing.

The present invention is directed to solving the various problems enumerated above in a single or one-piece conductive or metallic shield to eliminate all extraneous or separate components heretofore used to ground the connector shield, to locate the connector on the board, to lock the connector to the board and to ensure proper location of the jack screw-receiving apertures, all by various means integral with the one-piece shield.

SUMMARY OF THE INVENTION

An object, therefore, of the invention is to provide a new and improved shielded electrical connector having a one-piece conductive shield performing a multitude of functions within the intended design of the connector.

In the exemplary embodiment of the invention, the connector includes a dielectric housing having a front mating face, a rear terminating face and a bottom mounting portion adapted for mounting to the surface of the circuit board. A one-piece metallic shield is positionable against the front mating face of the housing. The one-piece shield includes an integral ground strap extending rearwardly beneath the bottom mounting portion of the housing and adapted for connection to an appropriate ground pad on the circuit board, an integral locating peg projecting below the bottom mounting portion and adapted for positioning in an appropriate locating hole in the circuit board, and an integral boardlock post projecting below the bottom mounting portion and adapted for positioning in an appropriate locking hole in the circuit board.

As disclosed herein, the locating peg projects downwardly from the ground strap. The boardlock post projects downwardly from a distal end of a support leg extending rearwardly beneath the bottom mounting portion of the housing. The locating peg is longer than the boardlock post.

The invention is shown in a connector wherein the dielectric housing and, correspondingly, the one-piece metallic shield are elongated. A set of each of the ground strap, locating peg and boardlock post are provided at each opposite end of the housing and shield. The housing includes a forwardly projecting mating portion, and the shield includes a shroud portion surrounding the forwardly facing mating portion.

Another feature of the invention is the provision of an ear portion of the shield wrapped about an edge of a flange of the housing. The ear portion has a threaded aperture located behind the flange portion of the housing for receiving a jack screw or jack screw post. The ear portion includes a positioning tab snappingly interengageable with a locking shoulder on the housing behind the flange thereof. The positioning tab is angled to provide a camming action which facilitates snappingly interengaging the tab with the locking shoulder on the housing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
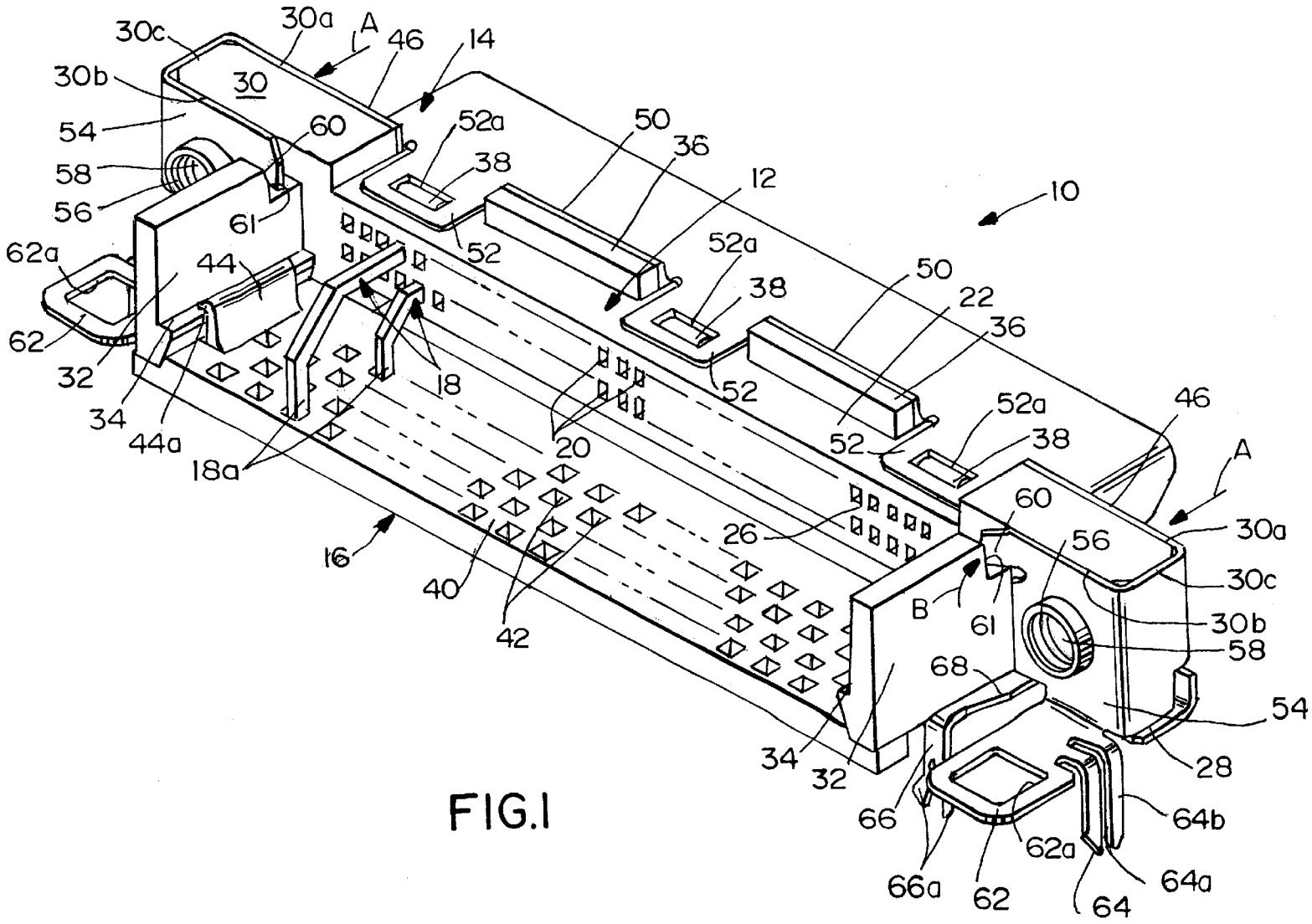
FIG. 1 is a rear perspective view of a shielded electrical connector incorporating the concepts of the invention.

Referring to the drawings in greater detail, and first to FIG. 1, the invention is embodied in a shielded electrical connector, generally designated 10, for mounting on a printed circuit board (not shown). Generally, the connector includes a housing, generally designated 12; a one-piece metallic shield, generally designated 14; a tail aligner, generally designated 16; and a plurality of terminals, generally designated 18, mounted in a plurality of terminal-receiving passages 20 in housing 12.

More particularly, dielectric housing 12 includes a forwardly projecting mating portion 22 which defines a front mating face 24 of the housing opposite a rear terminating face 26. The housing has a bottom mounting portion or face 28 adapted for mounting to the circuit board. A flange 30 projects laterally outwardly of the housing between forward mating face 24 and rear terminating face 26. The flange, itself, defines a front face 30a and a rear face 30*b*. The housing is elongated, and flange 30 projects laterally outwardly from opposite ends thereof. The housing has a pair of rearwardly projecting flanges 32 outside the array of terminal-receiving passages 20, the rearwardly projecting flanges including inwardly and upwardly directing locking shoulders 34. Lastly, housing 12 has a pair of abutment bosses 36 and three latch bosses 38 projecting upwardly from both the top and the bottom of forwardly projecting mating portion 22 of the housing, for purposes described hereinafter.

Tail aligner 16 is constructed of a generally plate-like member 40 having a plurality of through-holes 42 for receiving tail portions 18*a* of terminals 18. The holes properly space and align the tail portions of the terminals. The tail portions extend through the holes and into appropriate holes in the circuit board for connection, as by soldering, to circuit traces on the board and/or in the holes. The tail aligner is mounted to the housing by a pair of latching lips 44 at opposite ends of plate-like member 40. The latching lips have hook portions 40*a* for latchingly engaging locking shoulders 34 on the inside of rearwardly projecting flanges 32 of the housing.

Figure 2:
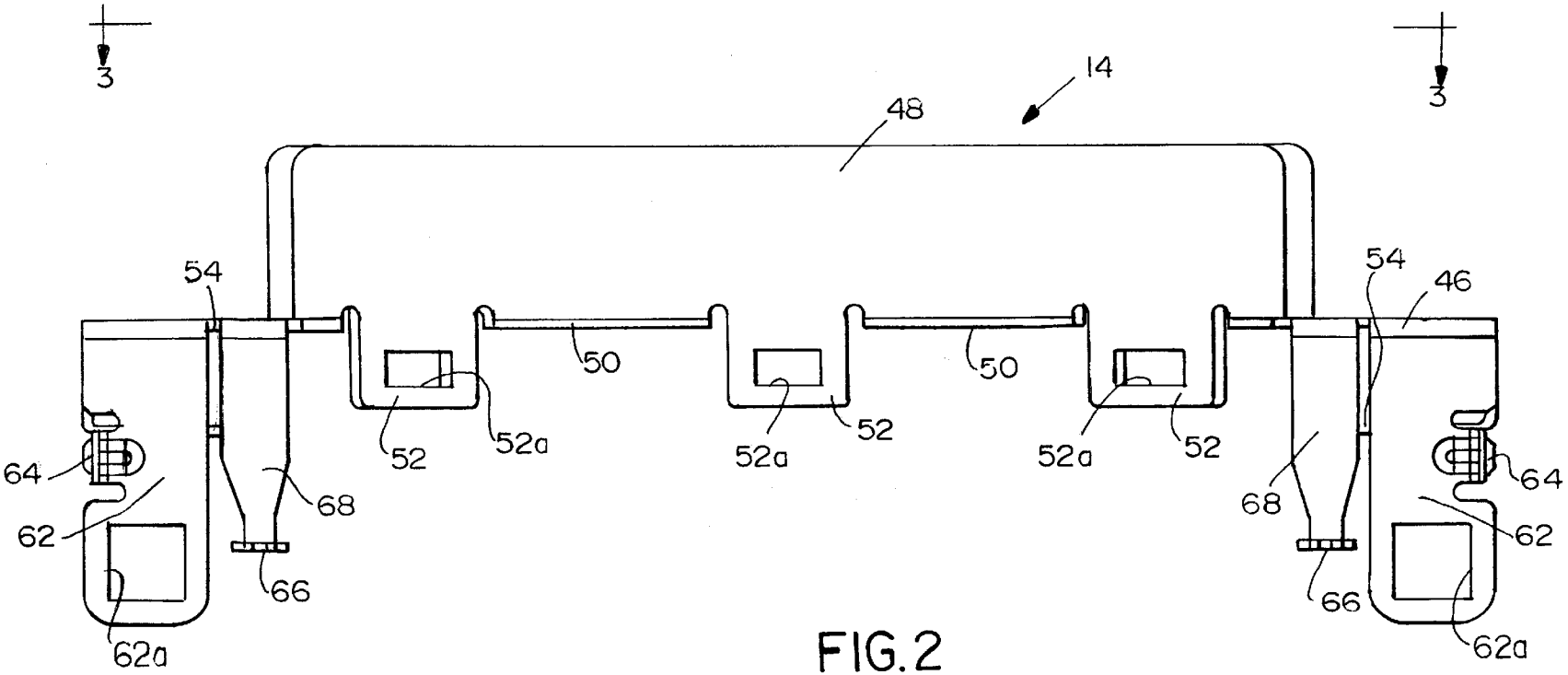
FIG. 2 is a bottom plan view of the one-piece metallic shield of He connector.

One-piece metallic shield 14 is stamped and formed of conductive sheet metal material and, generally, is positioned against the front of housing 12. Specifically, referring to FIGS. 2–4 in conjunction with FIG. 1, shield 14 includes a generally planar flange portion 46 which abuts against front face 30*a* of flange 30 of housing 12. An integral shroud portion 48 projects forwardly of flange portion 46 and surrounds forwardly projecting mating portion 22 of the housing. A pair of small abutment flanges 50 and three latch flanges 52 are formed out of both the top and the bottom of shroud portion 48 of the shield for interengagement with abutment bosses 36 and latch bosses 38 of the housing. Abutment flanges 50 of the shield abut against the front of abutment bosses 36 of the housing. Latch flanges 52 of the shield have apertures 52*a* for latchingly engaging latch bosses 38 of the housing. The abutment bosses/flanges and the latch bosses/flanges properly locate and latch the one-piece metallic shield onto the dielectric housing.

Flange portion 46 of shield 14 has an extended ear portion 54 at each opposite end of the connector, with the ear portions being wrapped about the extreme lateral outer edges of flange 30. Each ear portion 54 is provided with an internally threaded aperture 56 located behind flange 30 of the housing. Each aperture 56 is aligned with a through hole 58 in flange 30 of the housing and a through hole (not visible) in flange portion 46 of the shield. Jack screws or jack screw posts are inserted in the direction of arrows "A" from the front of the connector, through the aligned holes in flange portion 46 of the shield, through holes 58 in flange 30 of the housing, and into threaded into apertures 56 in ear portions 54 at the rear of the connector.

With the above-described structure of ear portions 54 and threaded apertures 56 of the shield, it can be understood that the jack screws or jack screw posts would have a tendency to push ear portions 54 rearwardly away from housing flange 30 if threaded apertures 56 are not precisely aligned with through holes 58. In order to solve this problem, positioning tabs 60 project inwardly of ear portions 54 for snappingly interengaging with locking shoulders 61 in rearwardly projecting flanges 32 of the housing. Positioning tabs 60 are angled to provide a camming action which facilitates snappingly interengaging the tabs with locking shoulders 61. In other words, one-piece shield 14 first is mounted to the front of housing 12 until flange portion 46 of the shield abuts front face 30a of flange 30 of the housing. Ear portions 54 then are wrapped or bent about outer edges 30*a* of flange 30 until positioning tabs 60 snap behind shoulders 61 in the direction of arrow "B"(FIG. 1).

One-piece metallic shield 14 includes integral means for locating the connector on the circuit board, for locking the connector to the board and for grounding the shield of the connector to ground pads on the board. More particularly, a ground strap 62, a locating peg 64 and a boardlock post 66 are formed integral with one-piece shield 14 at each opposite end of the shield and the connector. Each ground strap 62 extends from the bottom of front flange portion 46 of the shield rearwardly beneath bottom portion 28 of the housing and is adapted for connection to an appropriate ground pad on the circuit board. Each ground strap has a rectangular aperture 62*a* to facilitate solder connection of the ground strap to the ground pad on the circuit board.

Each locating peg 64 is formed integral with and projects downwardly from one of the ground straps 62 at the outer edge thereof as is seen clearly in FIG. 1. The locating peg is divided at 64*a* so that the peg is bifurcated to provide resiliency therefore. The ends of the locating peg are chamfered, as at 64*b*, to facilitate positioning of the peg in an appropriate locating hole in the circuit board. Each locating peg is sufficiently smaller than its respective locating hole in the board to provide easy location of the connector on the board.

Each boardlock post 66 is formed integrally with and projects downwardly from the distal end of a support leg 68 which extends rearwardly beneath bottom portion 28 of the housing from the bottom of front flange portion 46 of the shield. Each boardlock post 66 has a pair of outwardly spread, hooked legs 66*a* adapted for positioning in an appropriate locking hole in the circuit board. Hooked legs 66*a* of each boardlock post 66 establish a tight interference fit with its respective locking hole in the circuit board. This is in contrast to locating pegs 64 being sufficiently smaller than their locating holes in the board to provide free and easy insertion of the locating pegs into their respective holes.

Figure 3:
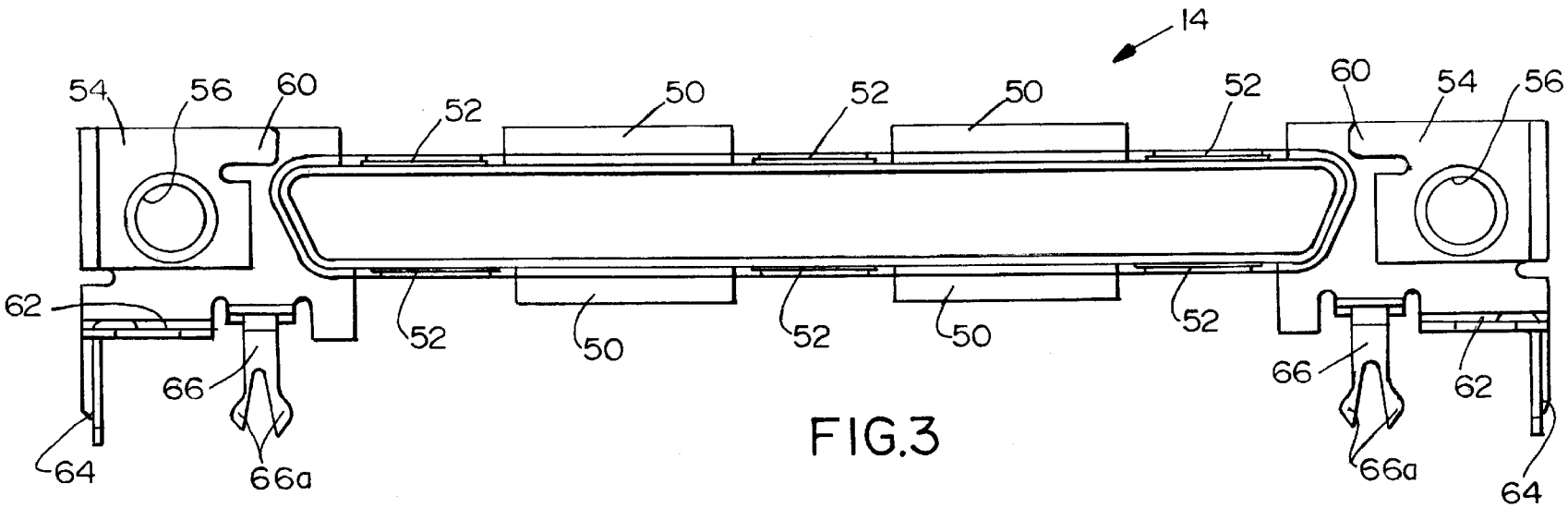
FIG. 3 is a rear elevational view of the shield.
Figure 4:
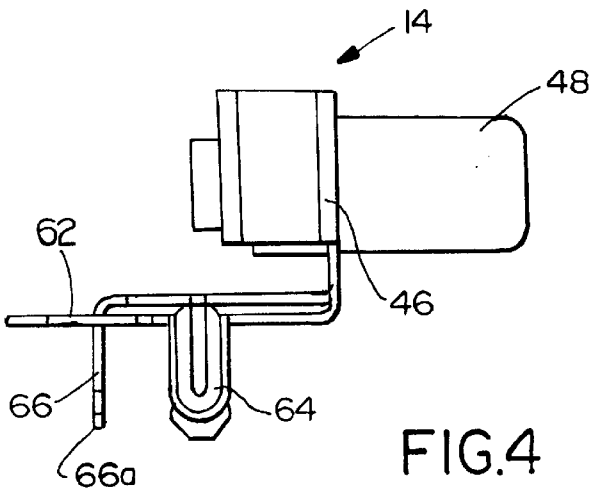
FIG. 4 is an end elevational view of the shield, looking toward the right-hand end of FIG. 3.

As seen best in FIGS. 3 and 4, locating pegs 64 are longer than boardlock posts 66. This differential in length is provided so that the locating pegs are movable freely into their respective locating holes in the board prior to engagement of the boardlock posts into their respective locking holes in the board. In other words, the boardlock posts must establish an interference fit with their respective locking holes. Therefore, the boardlocks posts are difficult to both align or locate the connector while still providing such a locking function. By using the longer, freely insertable locating pegs 64, the locating pegs must first enter their locating holes before the boardlock posts enter their locking holes. Of course, once the locating pegs enter their locating holes, the boardlock posts automatically are aligned with their locking holes, and the connector is easily forced into locking engagement and surface mounted on the circuit board. Grounding straps 62 and terminal tail portions 18 then are ready to be connected, as by soldering, to ground and circuit traces on the circuit board.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A shielded electrical connector for mounting to a circuit board, comprising:

an eloncated dielectric housing having a front mating face, a rear terminating face and a bottom mounting portion adapted for mounting to said circuit board; and an elongated one-piece metallic shield positionable generally at the front mating face and the rear terminating face of the housing, a shield portion at the rear terminating face including an integral ground strap extending rearwardly beneath the bottom mounting portion of the housing and adapted for connection to an appropriate ground pad on the circuit board, an integral locating peg projecting below the bottom mounting portion and adapted for positioning in an appropriate locating hole in the circuit board, and an integral boardlock post projecting below the bottom mounting portion and adapted for positioning in an appropriate locking hole in the circuit board, wherein the metallic shield includes a set of each of said ground strap, locating peg and boardlock post at each opposite end of the housing.

2. The shielded electrical connector of claim 1 wherein said locating peg projects downwardly from said ground strap.

3. The shielded electrical connector of claim 1 wherein said boardlock post projects downwardly from a distal end of a support leg extending rearwardly beneath the bottom mounting portion of the housing.

4. The shielded electrical connector of claim 3 wherein said locating peg projects downwardly from said ground strap.

5. The shielded electrical connector of claim 1 wherein said locating peg is longer than said boardlock post.

6. The shielded electrical connector of claim 1 wherein said housing includes a forwardly projecting mating portion, and the shield includes a shroud portion surrounding the forwardly facing mating portion.

7. A shielded electrical connector for mounting to a circuit board, comprising:

an elongated dielectric housing having a front mating face, a rear terminating face and a bottom mounting portion adapted for mounting to the surface of said circuit board; and an elongated one-piece conductive shield mounted on the front mating face and the rear terminating face of the housing, a shield portion at said rear terminating face including an integral ground strap for connection to an appropriate ground pad on the circuit board, an integral locating peg projecting below the bottom portion and adapted for positioning in an appropriate locating hole in the circuit board, and an integral boardlock post projecting below the bottom portion and adapted for positioning in an appropriate locking hole in the circuit board, wherein the shield includes a set of each of said ground strap, locating peg and boardlock post at each opposite end of the housing.

8. The shielded electrical connector of claim 7 wherein said locating peg projects downwardly from said ground strap.

9. The shielded electrical connector of claim 7 wherein said boardlock post projects downwardly from a distal end of a support leg extending rearwardly beneath the bottom mounting portion of the housing.

10. The shielded electrical connector of claim 9 wherein said locating peg projects downwardly from said ground strap.

11. The shielded electrical connector of claim 7 wherein said locating peg is longer than said boardlock post.

12. The shielded electrical connector of claim 7 wherein said housing includes a forwardly projecting mating portion, and the shield includes a shroud portion surrounding the forwardly facing mating portion.

13. A shielded electrical connector, comprising:

a dielectric housing having a front mating face and a rear terminating face with a laterally outwardly projecting flange located between the faces; and a metallic shield positionable generally at the front mating face of the housing and including an ear portion wrapped about an edge of the flange of the housing, the ear portion having an aperture at a front of the flange and a threaded aperture located at a rear of the flange, and the ear portion including a positioning tab snappingly interengaged with a locking shoulder on the housing behind the flange thereof.

14. The shielded electrical connector of claim 13 wherein said positioning tab is angled to provide a camming action which facilitates snappingly interengaging the tab with said locking shoulder.

15. The shielded electrical connector of claim 13 wherein said housing and said shield are elongated, and including an ear portion and positioning tab at each opposite end of the housing and shield.

16. The shielded electrical connector of claim 15 wherein said housing includes a forwardly projecting mating portion, and the shield includes a shroud portion surrounding the forwardly facing mating portion.

* * * * *